United States Patent [19]

Menchetti

[11] Patent Number: 4,845,904

[45] Date of Patent: Jul. 11, 1989

[54] C-STUD AND WEDGED BRACKET

[75] Inventor: Robert J. Menchetti, Buffalo, N.Y.

[73] Assignee: National Gypsum Company, Dallas, Tex.

[21] Appl. No.: 202,629

[22] Filed: Jun. 6, 1988

[51] Int. Cl.[4] ..... A47G 29/02

[52] U.S. Cl. ..... 52/36; 52/221; 52/238.1; 52/481; 248/246

[58] Field of Search ..... 52/36, 27, 221, 481, 52/238.1; 248/244, 246

[56] References Cited

U.S. PATENT DOCUMENTS

| | | | |
|---|---|---|---|
| 295,579 | 3/1884 | O'Brien | 248/244 |
| 2,744,714 | 5/1956 | Parke | 52/36 |
| 2,937,766 | 5/1960 | Penn | 52/36 |
| 3,081,718 | 3/1963 | Shoffner | 52/36 |
| 3,570,198 | 3/1971 | Ruhnke | 52/36 |
| 3,828,495 | 8/1974 | Law | 52/36 |
| 3,848,364 | 11/1974 | Costruba | 52/36 |
| 4,170,335 | 10/1979 | King | 248/246 |
| 4,274,614 | 6/1981 | Warrallo | 248/243 |
| 4,598,504 | 7/1986 | Itagaki | 52/36 |
| 4,637,178 | 1/1987 | Nimmo et al. | 52/36 |
| 4,731,960 | 3/1988 | Sease | 52/36 |

FOREIGN PATENT DOCUMENTS

| | | | |
|---|---|---|---|
| 992153 | 5/1965 | United Kingdom | 248/244 |

*Primary Examiner*—Michael Safavi

*Attorney, Agent, or Firm*—Laird F. Miller; Robert F. Hause

[57] ABSTRACT

A hollow C-shaped vertical metal stud and a furniture bracket affixed thereto. The bracket includes a back plate which is disposed, at a rearwardly and a downwardly angle, within the confines of the stud, whereby weight of furniture on the bracket wedges the back plate between the stud front and back walls, preventing downward movement.

7 Claims, 2 Drawing Sheets

C-STUD AND WEDGED BRACKET

BACKGROUND OF THE INVENTION

This invention relates to furniture and hardware supporting brackets, and particularly to a novel combination of an outwardly opening, elongate C-shaped stud and short, rigid brackets.

U.S. Pat. No. 3,492,766 discloses a relatively complex vertical metal wall stud, which contains, within an outwardly opening hollow section, an elongate slotted standard of generally U-shaped cross-sectional construction having a plurality of longitudinally extending slots at set intervals along the web. The slots are designed to accept ears on a standard bracket and retain the bracket to support the load of shelves.

SUMMARY OF THE INVENTION

The present invention provides a novel combination of a vertical metal stud and a furniture supporting bracket in which an outwardly opening C-shaped stud, with inwardly turned flanges on the open front side, has a metal bracket selectively positionable relative to the stud, with a bracket rear wall wedged between the back wall of the stud and the in-turned flanges on the front side of the stud. The bracket has a rear wall which, when in an operational position, has a bottom edge pressing backwardly and downwardly on the back wall of the stud while the bracket rear wall top edge is pressing forwardly against the surfaces of the inwardly directed flanges of the stud.

Wallboards are mounted against the front side of the C-shaped stud with a vertical joint between two adjacent wallboards located immediately over the vertical opening in the stud. The bracket has a main supporting web which extends, from the center of the bracket rear wall, outwardly through the joint between two adjacent wallboards. The main supporting web has means on the outer end for supporting furniture or the like.

It is an object of the invention to provide a novel structure for supporting wall furniture and the like.

It is a further object to provide a wall furniture bracket having improved ease of adjustment in its vertical position and with almost infinite variability in its vertical adjustability.

It is a further object to provide a wall structure with a furniture bracket, which bracket can be inserted into or removed from the main structure at any time by relatively simple steps.

It is a still further object to provide a novel wall furniture bracket having an affixation structure which permits a variety of forms of furniture attachment structure.

BRIEF DESCRIPTION OF THE DRAWINGS

These and other objects and advantages of the invention will be more readily apparent when considered in relation to the preferred embodiments, as set forth in the specification, and shown in the drawings, in which.

DESCRIPTION OF THE PREFERRED EMBODIMENTS

Figure 1:
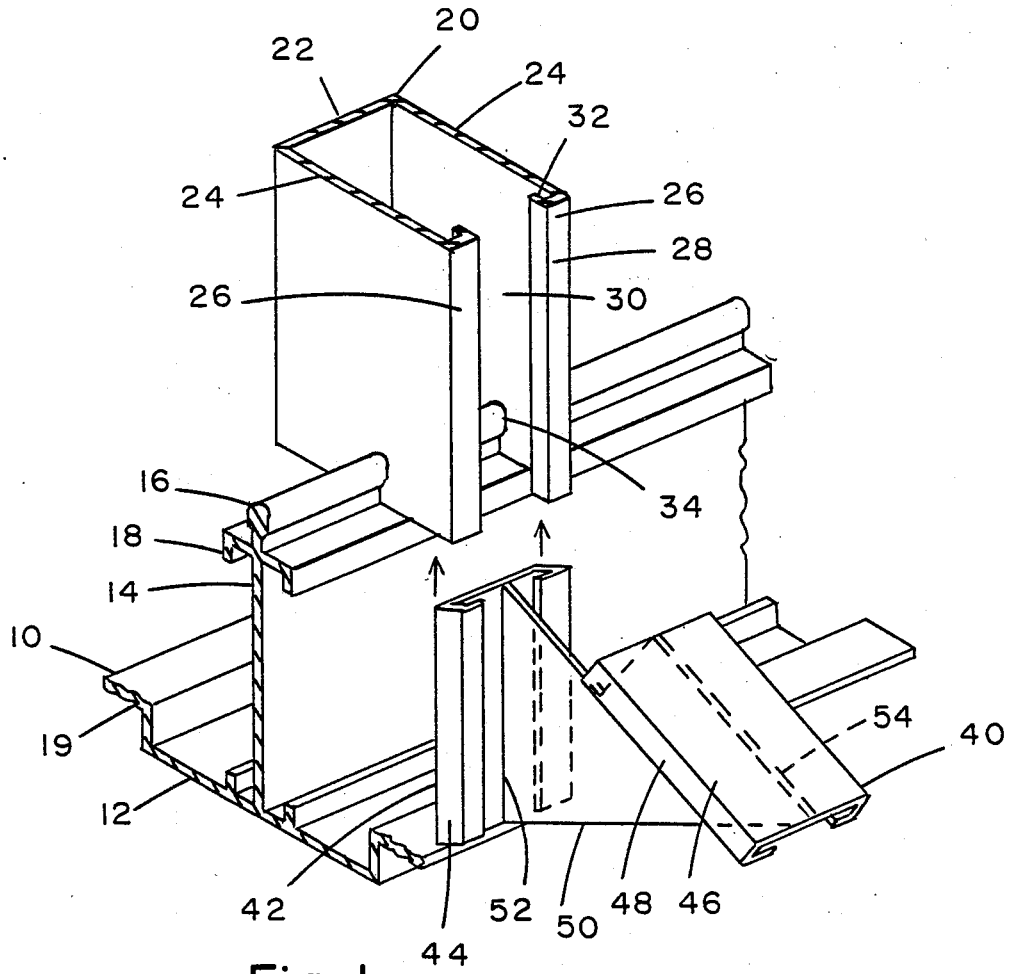
FIG. 1 is an isometric view of a furniture supporting bracket, constructed in accordance with the invention, disposed near the bottom of a C-shaped stud, in a position suitable for inserting the bracket rear wall into hollow interior of the stud.

Referring to FIG. 1, there is shown an elongate, aluminum, T-shaped floor track 10 including a base 12, a central vertical wall 14 which has an elongate bulbous top 16. Short flanges 18 extend outwardly and downwardly on each side of wall 14 just below bulbous top 16. An L-shaped, upwardly and outwardly extended base trim receiver 19 has serrated surfaces along the top and bottom.

A stud 20 is affixed to and vertically supported on base 10. Stud 20 has a C-shaped cross-section including a back wall 22, sidewalls 24 and a pair of spaced parallel flanges 26, directed toward one another forming a two part front wall 28, with an opening 30 between the two flanges 26. Short inwardly directed flanges 32 are located on the inner end of flanges 26, extending parallel to sidewalls 24.

Slots 34 are formed in the bottom edges of sidewalls 24, with a lower narrow portion 36 and an upper wide portion 38. the stud 20 is mounted on the base 12 with the bulbous top 16 extending through slots 34.

A furniture supporting bracket 40 is shown disposed in a location below the bottom of stud 20, in a position suitable for insertion into the opening 30. Bracket 40 includes a flat back plate 42, with inwardly directed, L-shaped stiffening flanges 44 along each side, a flat front plate 46 with inwardly directed, L-shaped stiffening flanges 48 along each side, and a central vertical flat web 50 adjoining the back plate 42 and the front plate 46. Flat web 50 is rigidly affixed to each of the back plate 42 along an innermost edge of the web 50, and the front plate 46 at an outer portion of web 50 along the vertical centerlines 52, 54 respectively, of plates 42, 46.

The back plate 42 and the front plate 46 are disposed, respectively, within planes which intersect at an acute angle of, preferably, about 40°, however this angle can be varied considerably, for example, from about 20° to about 80°.

The size of back plate 42 and the relative positions of back plate 42 and front plate 46 are of importance with respect to providing the preferred operative position of front plate 46 relative to a surface of a finished wall, as is discussed further below.

Figure 2:
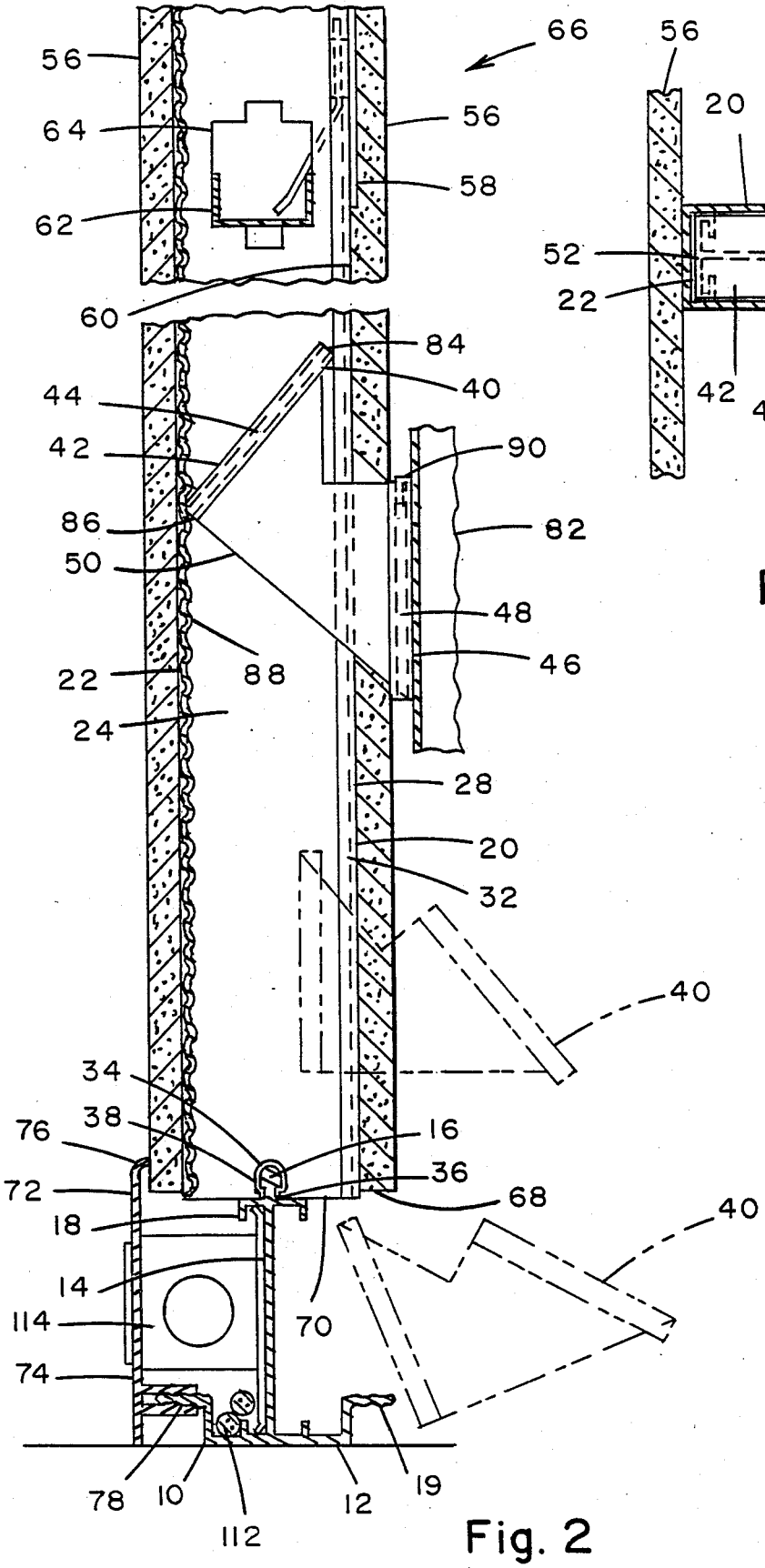
FIG. 2 is a vertical sectional view of a finished wall, showing the base trim removed, with the support bracket of FIG. 1 shown in an operational disposition and also showing, in shadow form, the movement of the bracket during insertion and placement.

Referring to FIG. 2, a stud 20 is shown with wallboard 56 mounted against both the back wall 22 and the front wall 28. In the preferred embodiment, the wallboard is held firmly against the stud by suspension clip assemblies 58 which are piercingly engaged in the back face 60 of wallboard 56 and which are hung on an upwardly opening channel 62 extending through knockouts 64 in a plurality of parallel vertical studs 20, located at two-foot spacings along a partition or wall 66. This preferred method of affixing wallboards to studs is more thoroughly described in U.S. Pat. No. 4,128,979, the disclosure of which is hereby incorporated by reference.

Wallboards 56 can also be affixed to the studs 20 by screws or an adhesive, in accordance with the present invention.

In a typical wall constructed in accordance with the invention, the stud 20 has a back wall 22 to front wall 28 dimension of about 2½ inches. The bottom edges 68 of wallboards 56 are disposed against, approximately the bottom edge 70 of stud 20.

Elongate rigid plastic base trim 72 is formed of a wide elongate face portion 74; a short, inwardly directed flange 76 is for firmly abutting the surface of wallboards 56. An elongate inwardly directed open channel 78 has serrated surfaces on the inside for engaging and holding the serrated surfaces of base trim receiver 19, thus holding base trim 72 in place. One base trim 72 in FIG. 2, is removed to permit the placement of the back plate 42 of a bracket 40 inside the stud 20, at a joint 80, between two coplanar wallboards 56; see FIG. 3.

As is shown in FIG. 2, the bracket back plate 42 is inserted within the stud 20 and caused to move upward, while in a vertical position, close to the two-part front wall 28, and if necessary, can be moved past the channel 62, to a desired location of some wall furniture, such as a wall closet 82, a portion of which is shown in FIG. 2. As the bracket 40 is being moved upwardly, the front plate 46 is angled outwardly and downwardly.

Figure 3:
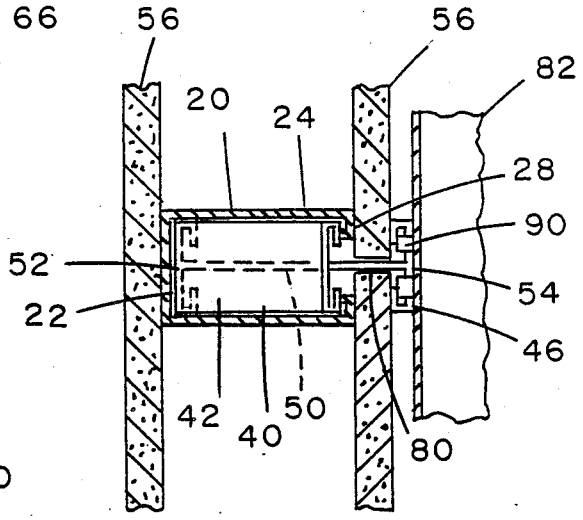
FIG. 3 is a horizontal sectional view of the wall of FIG. 2, showing the support bracket in an operational disposition, and further including a wall cabinet, or closet, mounted on the wall bracket.

When the bracket has been raised to its ultimate desired height, the front plate 46 is rotated to a vertical disposition, thus rotating the back plate 42 to a rearwardly and downwardly disposition. The size of the back plate 42 and the relative positions of back plate 42 and front plate 46 are such that when front plate 46 is in a vertical position, or, more particularly, in the ultimate position desired for supporting wall furniture, the back plate 42 has a top edge 84 pressing forwardly against two-part front wall 28 and a bottom edge 86 pressing firmly against back wall 22. FIG. 3 shows how top edge 84 and bottom edge 86 each have an extent perpendicular to the plane of central web 50, with the bottom edge 86 located further from front plate 46 by a distance equal to the depth of stud 20.

Back wall 22 preferably has knurling 88 formed in the inner surface, such as in the form of rough protuberances, or horizontal ribs, which knurling 88 acts to prevent the bracket 40 from moving downward, when a load is placed on front plate 46.

An example of a typical load is the wall closet 82, which can be affixed to the bracket 40 by a hook 90 on the back of the closet 82, or by screws (not shown). The downward force of the weight of the closet 82 tends to rotate the bracket 40 urging the back plate top edge 84 more firmly against front wall 28 and urging the back plate bottom edge 86 more firmly against the back wall 22 with the knurling 88.

Figure 4:
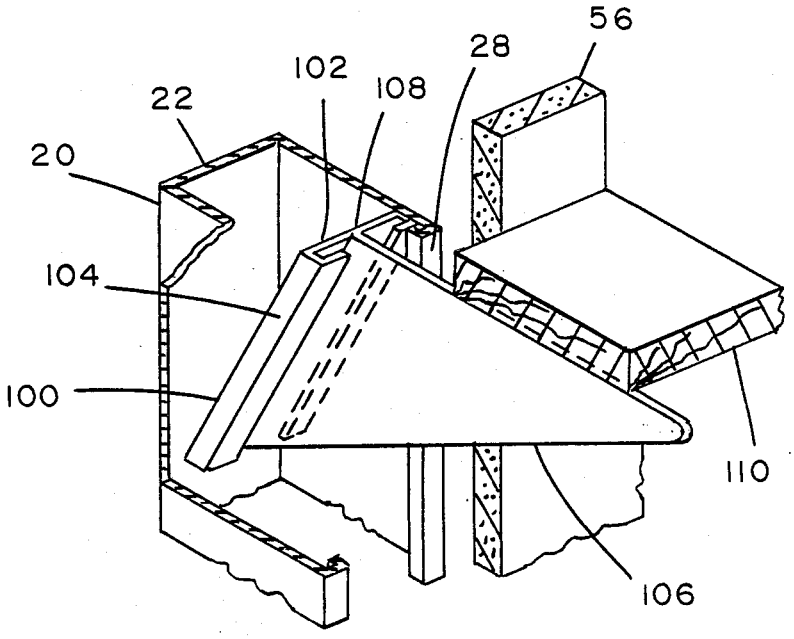
FIG. 4 is an isometric view of a modified form of the bracket of the invention, including a relatively long outwardly extending arm for supporting shelves.

FIG. 4 shows a modified form of bracket 100, having a flat back plate 102, with inwardly directed, L-shaped stiffener flanges 104 along each side and a vertical flat web 106, which is rigidly affixed to the back plate 102, along the vertical centerline 108 of the back plate 102. In this embodiment, the vertical flat web 106 has a substantially longer horizontal dimension, sufficient to form the support for a shelf 110, when the bracket is disposed with the back plate 102 within a stud 20, in its operative angled disposition, wedged between stud front wall 28 and stud back wall 22.

The T-shaped floor track 10, in combination with the bottom slotted stud 20, is of particular advantage in combination with the novel brackets 40, 100, in that the brackets 40, 100 can be added or removed from a wall 66 at any time simply by removing the easily replaceable base trim 72. This structure is also of particular significance in permitting easy accessibility to wiring 112 and to electrical receptacle boxes 114 which can be located behind the base trim 72.

Having completed a detailed disclosure of the preferred embodiments of my invention so that those skilled in the art may practice the same, I contemplate that variations may be made without departing from the essence of the invention.

I claim:

1. A vertical wall comprising a hollow vertical metal stud with a C-shaped cross-section, having a back wall, a pair of spaced parallel sidewalls, and a front wall, said front wall consisting of two spaced apart coplanar flanges directed toward one another and affixed to said respective sidewalls, a pair of coplanar wallboards affixed to said front wall, and a wall furniture supporting bracket, said bracket comprising a back plate and a flat central web, said central web having an outer portion with means thereon for supporting wall furniture and the like, said central web being disposed in a substantially vertical plane, said central web having an inner portion, which is inward from said outer portion, with an innermost edge which is rigidly affixed to said back plate along substantially a vertical centerline of said back plate, said web outer portion being connected to said web inner portion solely by a central flat portion of said web, said web extending through a vertical opening in said C-shaped stud, said back plate having an angled disposition, relative to vertical, with said back plate having a top edge engaging said C-shaped stud two-part front wall, which extends perpendicular to said substantially vertical plane of said central web, and a bottom edge engaging said C-shaped stud back wall, which extends perpendicular to said substantially vertical plane of said central web, said bottom edge being disposed horizontally inward from said top edge, whereby said back plate is wedged between said front wall and said back wall of said wall stud by the weight of furniture on said furniture supporting means, said bracket having said central web extending from within said hollow stud outward between said spaced flanges and between said coplanar wallboards, wherein said metal stud back wall has an inner surface having a roughened knurling thereon.

2. A vertical wall comprising a hollow vertical metal stud with a C-shaped cross-section, having a back wall, a pair of spaced parallel sidewalls, and a front wall, said front wall consisting of two spaced apart coplanar flanges directed toward one another and affixed to said respective sidewalls, a pair of coplanar wallboards affixed to said front wall, and a wall furniture supporting bracket, said bracket comprising a back plate and a flat central web, said central web having an outer portion with means thereon for supporting wall furniture and the like, said central web being disposed in a substantially vertical plane, said central web having an inner portion, which is inward from said outer portion, with an innermost edge which is rigidly affixed to said back plate along substantially a vertical centerline of said back plate, said web outer portion being connected to said web inner portion solely by a central flat portion of said web, said web extending through a vertical opening in said C-shaped stud, said back plate having an angled disposition, relative to vertical, with said back plate having a top edge engaging said C-shaped stud two-part front wall, which extends perpendicular to said substantially vertical plane of said central web, and a bottom edge engaging said C-shaped stud back wall, which extends perpendicular to said substantially vertical plane of said central web, said bottom edge being disposed horizontally inward from said top edge, whereby said back plate is wedged between said front wall and said back wall of said wall stud by the weight of furniture on said furniture supporting means, said bracket having said central web extending from within said hollow stud outward between said spaced flanges and between said coplanar wallboards, further comprising a floor track, said floor track having an inverted T-shape including a flat base and an upwardly extending central wall, said metal stud having a bottom, said stud bottom being supported by said central wall in spaced relation to said flat base, whereby said bracket is able to be inserted in or removed from the bottom of said stud.

3. A vertical wall as defined in claim 2 wherein said central wall of said floor track has means on a top portion thereof for being interlockingly engaged with a floor track receiving means on a bottom portion of said study.

4. A vertical wall as defined in claim 3 wherein said interlocking means on said floor track central wall is an elongate bulbous top and said interlocking means on said stud bottom portion consists of slots in said sidewalls.

5. A vertical wall as defined in claim 2 wherein said floor track base further comprises means for receiving and holding an elongate strip of base trim for concealing said floor track.

6. A vertical wall as defined in claim 5 wherein said base trim is readily demountable and remountable on said floor track base, whereby brackets can be easily added to or removed from said wall, and wiring and piping can be easily added to or removed from said wall.

7. A vertical wall comprising a hollow vertical metal stud with a C-shaped cross-section, having a back wall, a pair of spaced parallel sidewalls, and a front wall, said front wall consisting of two spaced apart coplanar flanges directed toward one another and affixed to said respective sidewalls, a pair of coplanar wallboards affixed to said front wall, and a wall furniture supporting bracket, said bracket comprising a back plate and a flat central web, said central web having an outer portion with means thereon for supporting wall furniture and the like, said central web being disposed in a substantially vertical plane, said central web having an inner portion, which is inward from said outer portion, with an innermost edge which is rigidly affixed to said back plate along substantially a vertical centerline of said back plate, said web outer portion being connected to said web inner portion solely by a central flat portion of said web, said web extending through a vertical opening in said C-shaped stud, said back plate having an angled disposition, relative to vertical, with said back plate having a top edge engaging said C-shaped stud two-part front wall, which extends perpendicular to said substantially vertical plane of said central web, and a bottom edge engaging said C-shaped stud back wall, which extends perpendicular to said substantially vertical plane of said central web, said bottom edge being disposed horizontally inward from said top edge, whereby said back plate is wedged between said front wall and said back wall of said wall stud by the weight of furniture on said furniture supporting means, said bracket having said central web extending from within said hollow stud outward between said spaced flanges and between said coplanar wallboards, wherein said wallboards are mounted and held against said vertical stud by suspension clip assemblies affixed to said wallboards, said suspension clip assemblies having means hung on an upwardly opening channel, said stud having knockouts in said stud sidewalls, and said channel being disposed through said knockouts.

* * * * *